US010147540B2

(12) United States Patent
Tonoyama et al.

(10) Patent No.: US 10,147,540 B2
(45) Date of Patent: Dec. 4, 2018

(54) PLANAR COIL ELEMENT AND METHOD FOR PRODUCING THE SAME

(71) Applicant: TDK CORPORATION, Tokyo (JP)

(72) Inventors: Kyohei Tonoyama, Tokyo (JP); Makoto Morita, Tokyo (JP); Tomokazu Ito, Tokyo (JP); Hitoshi Ohkubo, Tokyo (JP); Manabu Ohta, Tokyo (JP); Yoshihiro Maeda, Tokyo (JP); Yuuya Kaname, Tokyo (JP); Hideharu Moro, Tokyo (JP)

(73) Assignee: TDK CORPORATION, Tokyo (JP)

( * ) Notice: Subject to any disclaimer, the term of this patent is extended or adjusted under 35 U.S.C. 154(b) by 270 days.

(21) Appl. No.: 13/848,441

(22) Filed: Mar. 21, 2013

(65) Prior Publication Data

US 2013/0249664 A1 Sep. 26, 2013

(30) Foreign Application Priority Data

Mar. 26, 2012 (JP) ..... 2012-070014

(51) Int. Cl.

| | |
|---|---|
| ***H01F 27/255*** | (2006.01) |
| ***H01F 17/00*** | (2006.01) |
| ***H01F 27/28*** | (2006.01) |
| ***H01F 41/04*** | (2006.01) |
| *H01F 27/29* | (2006.01) |
| *H01F 17/04* | (2006.01) |

(52) U.S. Cl.

CPC ..... *H01F 41/04* (2013.01); *H01F 17/0013* (2013.01); *H01F 27/255* (2013.01); *H01F 41/046* (2013.01); *H01F 27/292* (2013.01); *H01F 2017/046* (2013.01)

(58) Field of Classification Search

CPC .. H01F 2017/048; H01F 27/292; H01F 17/04; H01F 27/255; H01F 17/0013

USPC ..... 336/200, 232

See application file for complete search history.

(56) References Cited

U.S. PATENT DOCUMENTS

| | | | | |
|---|---|---|---|---|
| 4,707,403 | A * | 11/1987 | Moriizumi et al. | 428/328 |
| 6,204,744 | B1 * | 3/2001 | Shafer et al. | 336/83 |
| 7,859,377 | B2 | 12/2010 | Kawarai | |
| 7,920,043 | B2 | 4/2011 | Nakagawa et al. | |
| 2003/0016114 | A1 * | 1/2003 | Shafer | 336/200 |
| 2006/0170524 | A1 * | 8/2006 | Fujiwara et al. | 336/83 |
| 2006/0279395 | A1 * | 12/2006 | Lee | H01F 1/26 336/221 |

(Continued)

FOREIGN PATENT DOCUMENTS

| | | | |
|---|---|---|---|
| JP | 10106839 A | * | 4/1998 |
| JP | 2004-273564 A | | 9/2004 |

(Continued)

*Primary Examiner* — Tsz Chan

(74) *Attorney, Agent, or Firm* — Oliff PLC

(57) ABSTRACT

In a planar coil element and a method for producing the same, a metal magnetic powder-containing resin containing an oblate or needle-like first metal magnetic powder contains a second metal magnetic powder having an average particle size (1 μm) smaller than that (32 μm) of the first metal magnetic powder, which significantly reduces the viscosity of the metal magnetic powder-containing resin. Therefore, the metal magnetic powder-containing resin is easy to handle when applied to enclose a coil unit, which makes it easy to produce the planar coil element.

10 Claims, 13 Drawing Sheets

(56) References Cited

U.S. PATENT DOCUMENTS

| | | | | |
|---|---|---|---|---|
| 2008/0231401 | A1* | 9/2008 | Lee et al. | 336/83 |
| 2009/0002117 | A1* | 1/2009 | Kawarai | 336/233 |
| 2009/0243780 | A1* | 10/2009 | Inoue et al. | 336/200 |
| 2010/0289609 | A1* | 11/2010 | Liao et al. | 336/221 |
| 2013/0228717 | A1 | 9/2013 | Harada et al. | |

FOREIGN PATENT DOCUMENTS

| | | | | |
|---|---|---|---|---|
| JP | 2006278909 | A | * | 10/2006 |
| JP | 2006310716 | A | * | 11/2006 |
| JP | A-2007-067214 | | | 3/2007 |
| JP | A-2009-9985 | | | 1/2009 |
| JP | A-2011-192729 | | | 9/2011 |
| JP | 2013-051329 | A | | 3/2013 |
| KR | 10-2008-0063783 | | | 7/2008 |

* cited by examiner

FIG. 9

| | AVERAGE PARTICLE SIZE (μm) OF FIRST METAL MAGNETIC POWDER (AVERAGE ASPECT RATIO: 2.8) | AVERAGE ASPECT RATIO OF SECOND METAL MAGNETIC POWDER (AVERAGE PARTICLE SIZE: 1 μm) | ROTATION SPEED (rpm) | VISCOSITY (mPa·s) |
|---|---|---|---|---|
| SAMPLE 1 | 32 | 1.2 | 1 | 250000 |
| | | | 2.5 | 148000 |
| | | | 5 | 104000 |
| | | | 10 | 80000 |
| SAMPLE 2 | 21 | 1.2 | 1 | 300000 |
| | | | 2.5 | 177600 |
| | | | 5 | 124000 |
| | | | 10 | 96000 |
| SAMPLE 3 | 40 | 1.2 | 1 | 240000 |
| | | | 2.5 | 140000 |
| | | | 5 | 98000 |
| | | | 10 | 76000 |
| SAMPLE 4 | 32 | 2.8 | 1 | 680000 |
| | | | 2.5 | 500000 |
| | | | 5 | 426000 |
| | | | 10 | 290000 |
| SAMPLE 5 | 21 | 2.8 | 1 | 760000 |
| | | | 2.5 | 560000 |
| | | | 5 | 498000 |
| | | | 10 | 411000 |
| SAMPLE 6 | 40 | 2.8 | 1 | 640000 |
| | | | 2.5 | 468000 |
| | | | 5 | 398000 |
| | | | 10 | 270000 |

| | AVERAGE PARTICLE SIZE (μm) OF FIRST METAL MAGNETIC POWDER (AVERAGE ASPECT RATIO: 2.8) | AVERAGE PARTICLE SIZE (μm) OF SECOND METAL MAGNETIC POWDER | ROTATION SPEED (rpm) | VISCOSITY (mPa·s) |
|---|---|---|---|---|
| SAMPLE A | 32 | 1 | 1 | 250000 |
| | | | 2.5 | 148000 |
| | | | 5 | 104000 |
| | | | 10 | 80000 |
| SAMPLE B | 32 | 4 | 1 | 400000 |
| | | | 2.5 | 220000 |
| | | | 5 | 142000 |
| | | | 10 | 96000 |
| SAMPLE C | 32 | 7 | 1 | 540000 |
| | | | 2.5 | 360000 |
| | | | 5 | 242000 |
| | | | 10 | 164000 |

| | AVERAGE PARTICLE SIZE (μm) OF FIRST METAL MAGNETIC POWDER (AVERAGE ASPECT RATIO: 2.8) | AVERAGE PARTICLE SIZE (μm) OF SECOND METAL MAGNETIC POWDER | ROTATION SPEED (rpm) | VISCOSITY (mPa·s) |
|---|---|---|---|---|
| SAMPLE D | 21 | 1 | 1 | 300000 |
| | | | 2.5 | 177600 |
| | | | 5 | 124000 |
| | | | 10 | 96000 |
| SAMPLE E | 21 | 4 | 1 | 480000 |
| | | | 2.5 | 264000 |
| | | | 5 | 172000 |
| | | | 10 | 115000 |
| SAMPLE F | 21 | 7 | 1 | 648000 |
| | | | 2.5 | 432000 |
| | | | 5 | 292000 |
| | | | 10 | 196000 |

| | AVERAGE PARTICLE SIZE (μm) OF FIRST METAL MAGNETIC POWDER (AVERAGE ASPECT RATIO: 2.8) | AVERAGE PARTICLE SIZE (μm) OF SECOND METAL MAGNETIC POWDER | ROTATION SPEED (rpm) | VISCOSITY (mPa·s) |
|---|---|---|---|---|
| SAMPLE G | 40 | 1 | 1 | 240000 |
| | | | 2.5 | 140000 |
| | | | 5 | 98000 |
| | | | 10 | 76000 |
| SAMPLE H | 40 | 4 | 1 | 380000 |
| | | | 2.5 | 208000 |
| | | | 5 | 134000 |
| | | | 10 | 91000 |
| SAMPLE I | 40 | 7 | 1 | 510000 |
| | | | 2.5 | 342000 |
| | | | 5 | 230000 |
| | | | 10 | 156000 |

PLANAR COIL ELEMENT AND METHOD FOR PRODUCING THE SAME

BACKGROUND OF THE INVENTION

Field of the Invention

The present invention relates to a planar coil element and a method for producing the planar coil element.

Related Background Art

Surface mount-type planar coil elements are conventionally used in various electrical products such as household devices and industrial devices. In particular, small portable devices have come to be required to obtain two or more voltages from a single power source to drive individual devices due to enhanced functions. Therefore, surface mount-type planar coil elements are used also as power sources to satisfy such a requirement.

One of such planar coil elements is disclosed in, for example, Japanese Patent Application Laid-Open (JP-A) No. 2009-9985. The planar coil element disclosed in this document includes an air core coil formed in a spiral shape in a plane and a magnetic sheet stacked on the air core coil and containing an oblate or needle-like soft magnetic metal powder dispersed in a resin material.

The air core coil may be covered with a resin paste containing an oblate or needle-like soft magnetic metal powder dispersed therein. However, when the soft magnetic metal powder has an oblate or needle-like shape, the resin paste has high viscosity. Such a high viscosity resin paste is very difficult to handle in some sort of production process such as printing.

SUMMARY OF THE INVENTION

In order to solve the above problem, it is an object of the present invention to provide a planar coil element that can be easily produced using an easy-to-handle resin and a method for producing the planar coil element.

The present invention is directed to a planar coil element including: a coil unit including a substrate and a conductor pattern for planar coil provided on the substrate; a metal magnetic powder-containing resin applied to enclose the coil unit; an oblate or needle-like first metal magnetic powder contained in the metal magnetic powder-containing resin and a second metal magnetic powder contained in the metal magnetic powder-containing resin and having an average particle size smaller than that of the first metal magnetic powder.

In the planar coil element, the metal magnetic powder-containing resin containing the oblate or needle-like first metal magnetic powder contains the second metal magnetic powder having an average particle size smaller than that of the first metal magnetic powder, which significantly reduces the viscosity of the metal magnetic powder-containing resin. Therefore, the metal magnetic powder-containing resin is easy to handle when applied to enclose the coil unit, which makes it easy to produce the planar coil element according to the present invention.

The present invention is also directed to a method for producing a planar coil element including the steps of: preparing a coil unit including a substrate and a conductor pattern for planar coil provided on the substrate; preparing a metal magnetic powder-containing resin paste containing an oblate or needle-like first metal magnetic powder and a second metal magnetic powder having an average particle size smaller than that of the first metal magnetic powder; and applying the metal magnetic powder-containing resin paste to enclose the coil unit and curing the metal magnetic powder-containing resin paste.

According to the method for producing a planar coil element, the metal magnetic powder-containing resin containing the oblate or needle-like first metal magnetic powder contains the second metal magnetic powder having an average particle size smaller than that of the first metal magnetic powder, which significantly reduces the viscosity of the metal magnetic powder-containing resin. Therefore, the metal magnetic powder-containing resin is easy to handle in the step of applying the metal magnetic powder-containing resin to enclose the coil unit and curing the metal magnetic powder-containing resin, which makes it easy to produce a planar coil element.

The second metal magnetic powder may have an average aspect ratio of 1.0 to 1.5. The second metal magnetic powder may have an average particle size of 1 to 4 μm.

According to the present invention, it is possible to provide a planar coil element that can be easily produced using an easy-to-handle metal magnetic powder-containing resin and a method for producing the planar coil element.

BRIEF DESCRIPTION OF THE DRAWINGS

FIG. 9 is a table showing samples used in an experiment on average aspect ratio;

DESCRIPTION OF THE PREFERRED EMBODIMENTS

Figure 1:
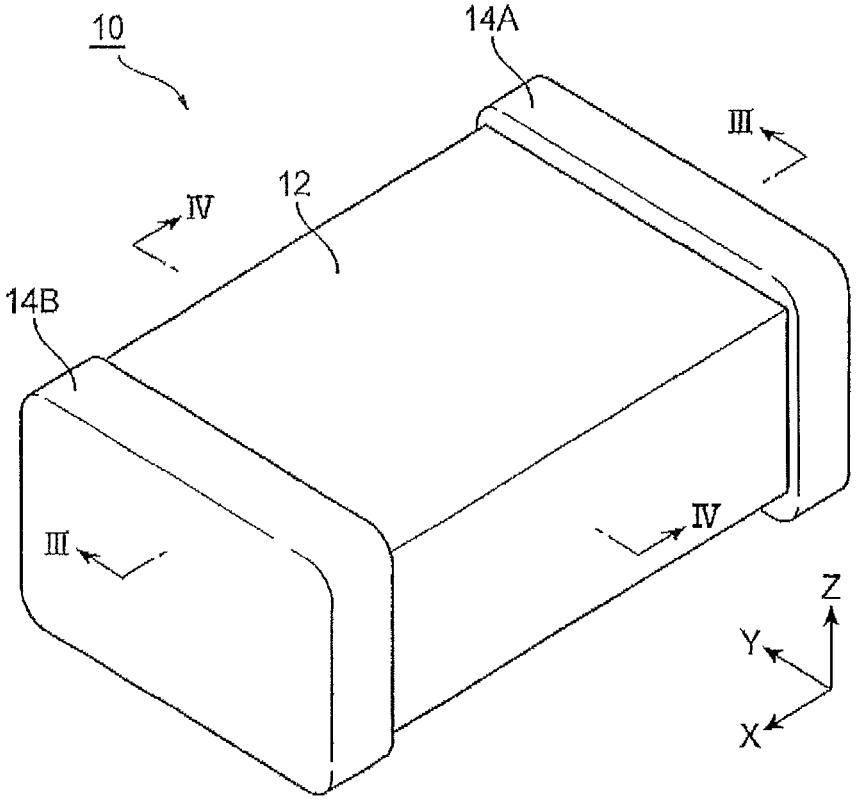
FIG. 1 is a schematic perspective view of a planar coil element according to an embodiment of the present invention.
Figure 2:
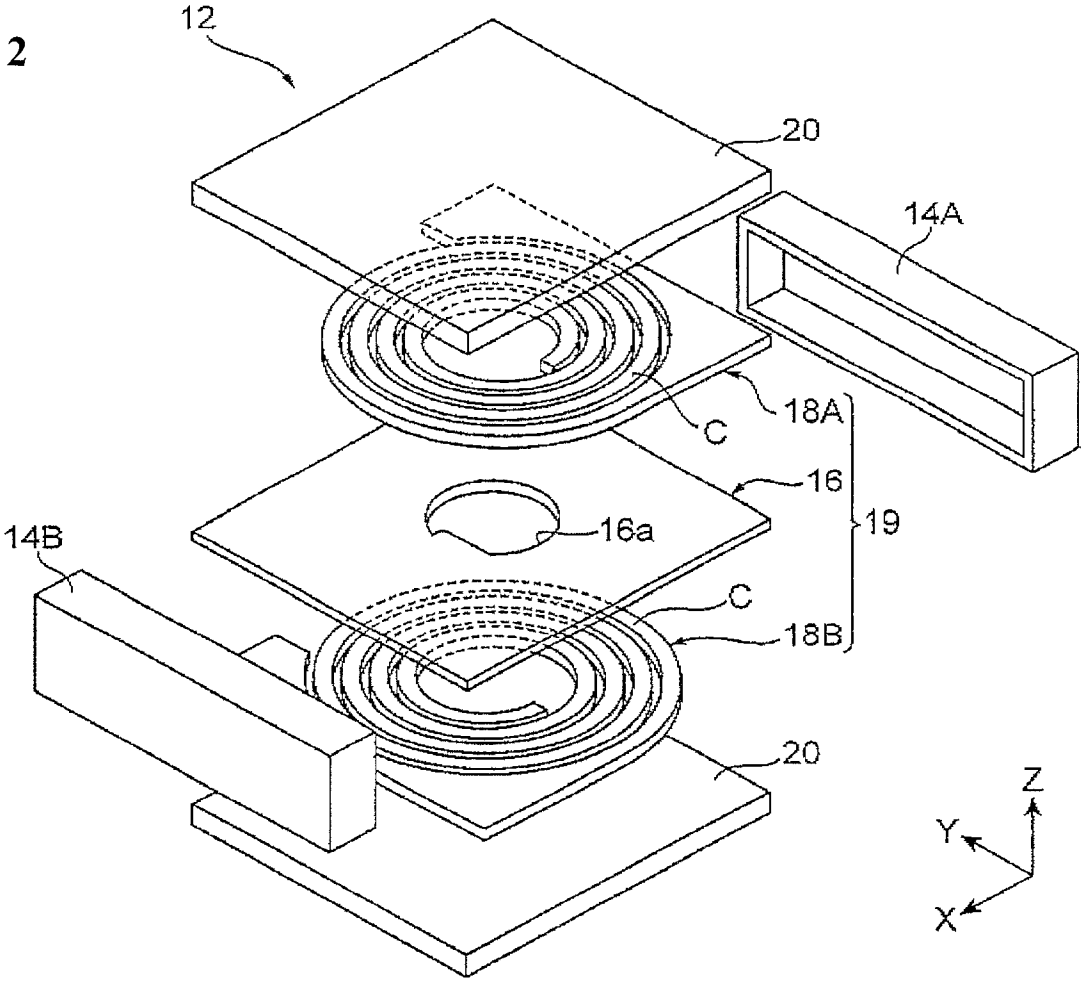
FIG. 2 is an exploded view of the planar coil element shown in FIG. 1.
Figure 3:
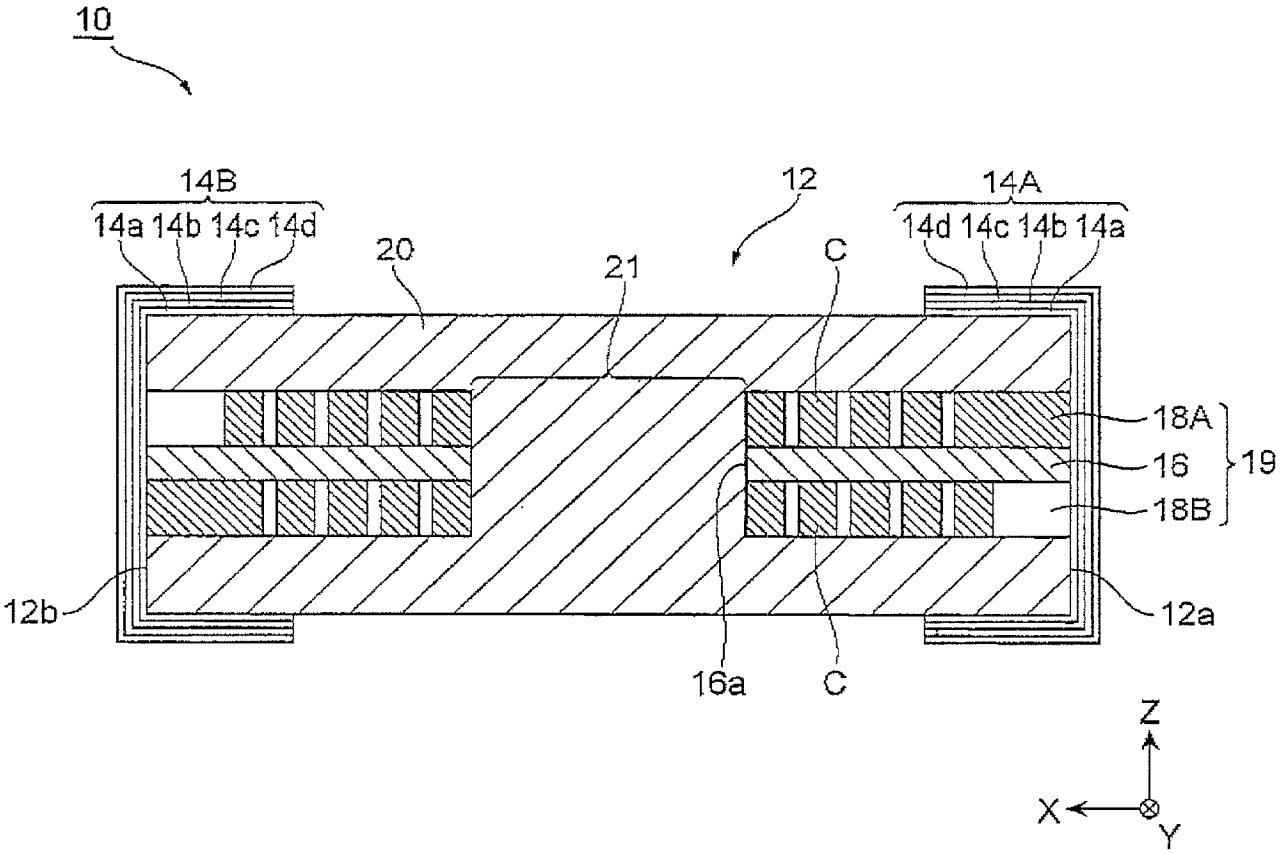
FIG. 3 is a sectional view of the planar coil element taken along a line III-III in FIG. 1.
Figure 4:
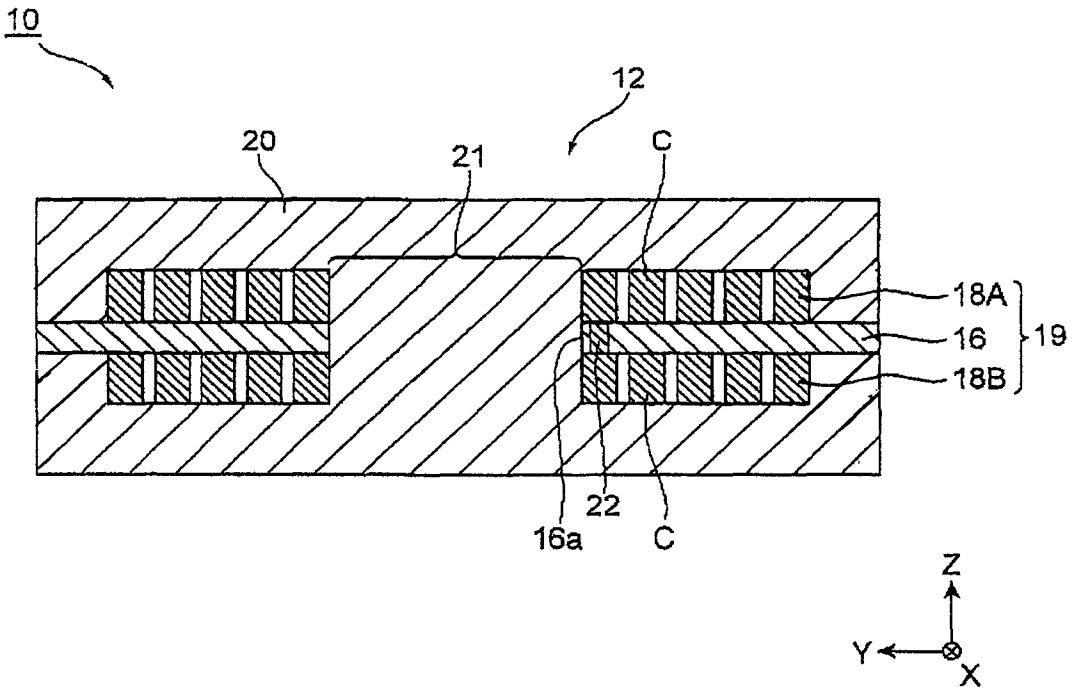
FIG. 4 is a sectional view of the planar coil element taken along a line IV-IV in FIG. 1.

Hereinbelow, a preferred embodiment of the present invention will be described in detail with reference to the accompanying drawings. It is to be noted that in the following description, the same elements or elements having the same function are represented by the same reference numerals and description thereof will not be repeated.

First, the structure of a planar coil element according to an embodiment of the present invention will be described with reference to FIGS. 1 to 4. For convenience of description, as shown in the drawings, X-, Y-, and Z-coordinates are set. More specifically, the thickness direction of the planar coil element is defined as a Z direction, a direction in which external terminal electrodes are opposed to each other is defined as an X direction, and a direction orthogonal to the X direction and the Z direction is defined as a Y direction.

A planar coil element 10 includes a main body 12 having a rectangular parallelepiped shape and a pair of external terminal electrodes 14A and 14B provided to cover a pair of opposing end faces 12*a* and 12*b* of the main body 12. The planar coil element 10 is designed to have, for example, a long side of 2.5 mm, a short side of 2.0 mm, and a height of 0.8 to 1.0 mm.

The main body 12 has a coil unit 19 having a substrate 16 and conductor patterns 18A and 18B for planar air core coil which are provided on both upper and lower sides of the substrate 16.

The substrate 16 is a plate-like rectangular member made of a non-magnetic insulating material. In the central part of the substrate 16, an approximately-circular opening 16*a* is provided. As the substrate 16, a substrate obtained by impregnating a glass cloth with a cyanate resin (BT (bismaleimide triazine) resin: trademark) and having a thickness of 60 μm can be used. It is to be noted that polyimide, aramid, or the like may be used instead of BT resin. As a material of the substrate 16, ceramics or glass may also be used. Preferred examples of material of the substrate 16 include mass-produced printed circuit board materials, and particularly, resin materials used for BT printed circuit boards, FR4 printed circuit boards, or FR5 printed circuit boards are most preferred.

Both the conductor patters 18A and 18B are planar spiral patterns constituting a planar air core coil and are formed by plating with a conductive material such as Cu. It is to be noted that the surfaces of the conductor patterns 18A and 18B are coated with an insulating resin (not shown). A winding wire C of the conductor patterns 18A and 18B has, for example, a height of 80 to 120 μm, a width of 70 to 85 μm, and a winding pitch of 10 to 15 μm.

The conductor pattern 18A is provided on the upper surface of the substrate 16, and the conductor pattern 18B is provided on the lower surface of the substrate 16. The conductor patterns 18A and 18B are almost superimposed with the substrate 16 being interposed therebetween, and both of them are provided to surround the opening 16*a* of the substrate 16. Therefore, a through hole (magnetic core 21) is provided in the coil unit 19 by the opening 16*a* of the substrate 16 and the air cores of the conductor patterns 18A and 18B.

The conductor pattern 18A and the conductor pattern 18B are electrically connected to each other by a via-hole conductor 22 provided to penetrate through the substrate 16 near the magnetic core 21 (i.e., near the opening 16*a*). Further, the conductor pattern 18A provided on the upper surface of the substrate spirals outwardly in a counterclockwise direction when viewed from the upper surface side, and the conductor pattern 18B provided on the lower surface of the substrate spirals outwardly in a counterclockwise direction when viewed from the lower surface side, which makes it possible to pass an electrical current through the conductor patterns 18A and 18B connected by the via-hole conductor 22 in a single direction. When an electrical current is passed through the conductor patterns 18A and 18B in a single direction, a direction in which the electrical current passing through the conductor pattern 18A rotates and a direction in which the electrical current passing through the conductor pattern 18B rotates are the same, and therefore magnetic fluxes generated by both the conductor patterns 18A and 18B are superimposed and enhance each other Further, the main body 12 has a metal magnetic powder-containing resin 20 enclosing the coil unit 19. As a resin material of the metal magnetic powder-containing resin 20, for example, a thermosetting epoxy resin is used. The metal magnetic powder-containing resin 20 integrally covers the conductor pattern 18A and the upper surface of the substrate 16 on the upper side of the coil unit 19 and integrally covers the conductor pattern 18B and the lower surface of the substrate 16 on the lower side of the coil unit 19. Further, the metal magnetic powder-containing resin 20 also fills the through hole provided in the coil unit 19 as the magnetic core 21.

Figure 5:
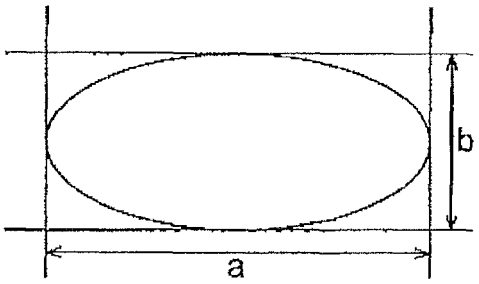
FIG. 5 is a diagram for explaining the aspect ratio of a metal magnetic powder.

In the metal magnetic powder-containing resin 20, a first metal magnetic powder 30 is dispersed. The first metal magnetic powder 30 has an oblate shape. The first metal magnetic powder 30 is made of, for example, an iron-nickel alloy (permalloy). The average particle size of the first metal magnetic powder 30 is about 32 μm. As shown in FIG. 5, when the lengths of major and minor axes are defined as a and b, respectively, the average aspect ratio (a/b) of the first metal magnetic powder is in the range of 2.0 to 3.2. It is to be noted that the first metal magnetic powder 30 may have a needle-like shape.

Further, in the metal magnetic powder-containing resin 20, an approximately-spherical metal magnetic powder is uniformly dispersed as a second metal magnetic powder 32 in addition to the first metal magnetic powder 30. The second metal magnetic powder 32 is made of, for example, carbonyl iron. The second metal magnetic powder 32 has an average particle size of about 1 μm and an aspect ratio (a/b) of 1.0 to 1.5. The average particle size of the second metal magnetic powder 32 is preferably smaller from the viewpoint of magnetic permeability, but a metal magnetic powder having an average particle size smaller than 1 μm is very hard to obtain due to cost problems and the like.

The metal magnetic powder-containing resin 20 is designed so that the amount of the first metal magnetic powder 30 and the second metal magnetic powder 32 contained therein is in the range of 90 to 98 wt %. Further, the metal magnetic powder-containing resin 20 is designed so that the mixing ratio by weight between the first metal magnetic powder 30 and the second metal magnetic powder 32 is in the range of 90/10 to 50/50.

The pair of external terminal electrodes 14A and 14B are electrodes intended to connect the planar coil element 10 to the circuit of an element-mounting substrate, and are connected to the above-described conductor patterns 18A and 18B. More specifically, the external terminal electrode 14A that covers the end face 12*a* of the main body 12 is connected to the end of the conductor pattern 18A exposed at the end face 12*a*, and the external terminal electrode 14B that covers the end face 12*b* opposed to the end face 12*a* is connected to the end of the conductor pattern 18B exposed at the end face 12*b*. Therefore, when a voltage is applied between the external terminal electrodes 14A and 14B, for example, an electrical current flowing from the conductor pattern 18A to the conductor pattern 18B is generated.

Each of the external terminal electrodes 14A and 14B has a four-layer structure including, in order of increasing distance from the main body 12, a Cr sputtered layer 14*a*, a Cu sputtered layer 14*b*, a Ni plated layer 14*c*, and a Sn plated layer 14*d*.

Hereinbelow, the procedure of producing the above-described planar coil element 10 will be described with reference to FIG. 6.

Figure 6C:
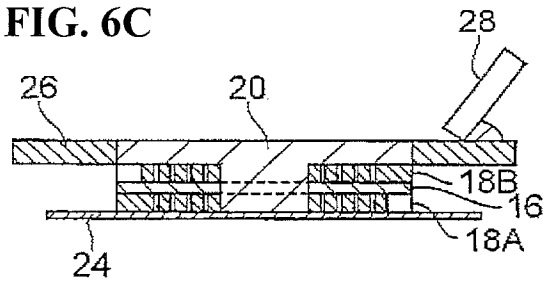
FIGS. 6A to 6E are diagrams illustrating the production steps of the planar coil element shown in FIG. 1.
Figure 6B:
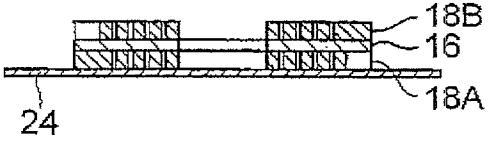
Figure 6A:
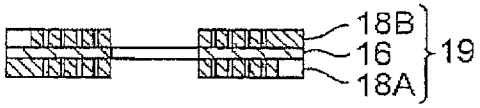
Figure 6E:
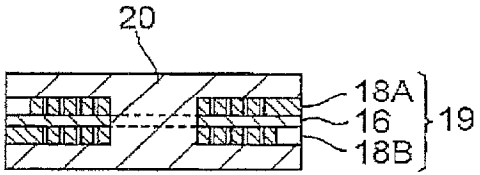

In order to produce the planar coil element 10, the coil unit 19, in which the conductor patterns 18A and 18B are formed by plating on the upper and lower sides of the substrate 16, is first prepared (see FIG. 6A). The plating may be performed by a well-known plating method. When an electrolytic plating method is used to form the conductor patterns 18A and 18B, a foundation layer needs to be previously formed by non-electrolytic plating. It is to be noted that the conductor pattern may be subjected to surface roughening treatment to have surface irregularities or to oxidation treatment to have an oxide film in order to improve adhesive strength between the conductor pattern and the metal magnetic powder-containing resin 20 or to allow the metal magnetic powder-containing resin paste 20 to easily enter the spaces between adjacent turns of the winding wire C.

Then, the coil unit 19 is fixed onto a UV tape 24 (see FIG. 6B). It is to be noted that the UV tape 24 is intended to suppress the warpage of the substrate 16 during subsequent treatment.

Then, the above-described metal magnetic powder-containing resin paste 20 containing the first metal magnetic powder 30 and the second metal magnetic powder 32 dispersed therein is prepared, and is applied onto the coil unit 19 fixed with the UV tape 24 by screen printing using a mask 26 and a squeegee 28 (see FIG. 6C). This makes it possible to integrally cover the conductor pattern 18B-side surface of the substrate 16 with the metal magnetic powder-containing resin paste 20 as well as to fill the through hole in the magnetic core 21 with the metal magnetic powder-containing resin 20. After the application of the metal magnetic powder-containing resin paste 20, predetermined curing treatment is performed.

Figure 6D:
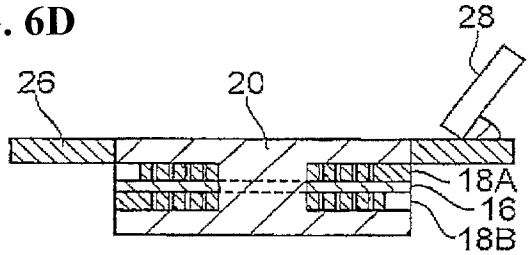

Then, the coil unit 19 is turned upside down and the UV tape 24 is removed, and the metal magnetic powder-containing resin paste 20 is again applied by screen printing (see FIG. 6D). This makes it possible to integrally cover the conductor pattern 18A-side surface of the substrate 16 with the metal magnetic powder-containing resin paste 20. After the application of the metal magnetic powder-containing resin paste 20, predetermined curing treatment is performed.

Then, dicing is performed to obtain a predetermined size (see FIG. 6D). Finally, the external terminal electrodes 14A and 14B are formed by sputtering and plating to complete the production of the planar coil element 10.

Figure 7:
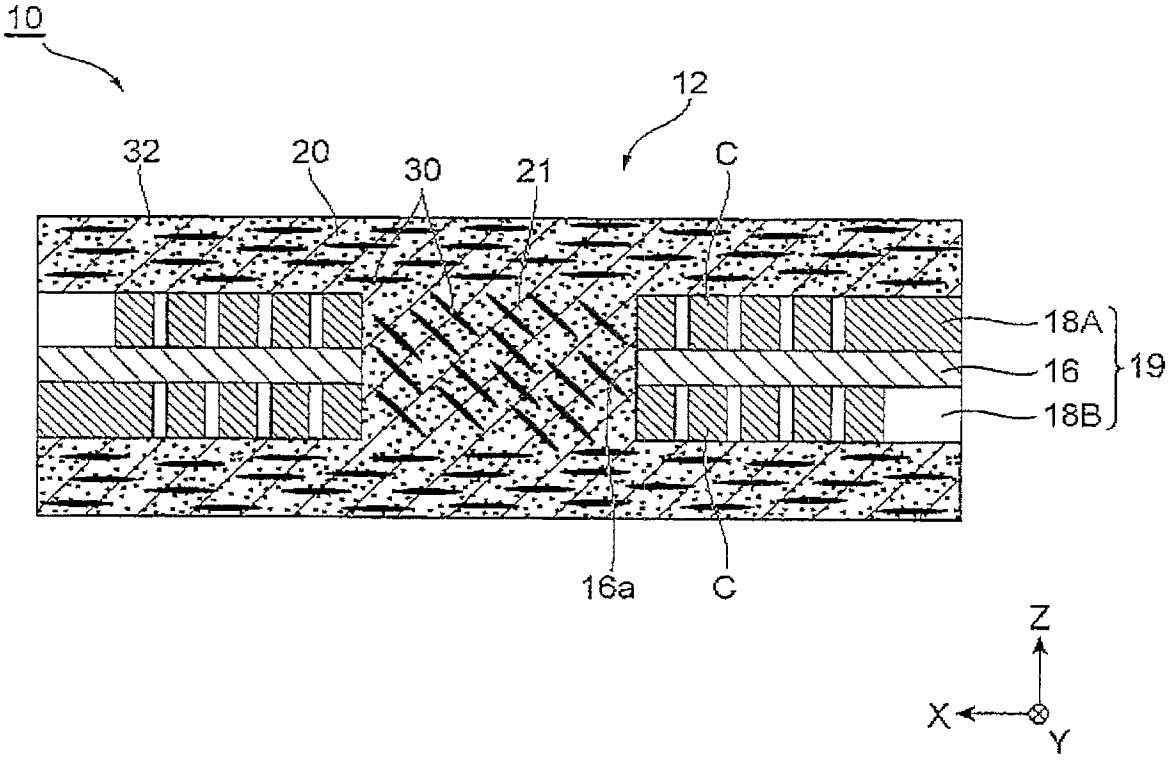
FIG. 7 is a diagram illustrating the orientation of particles of the metal magnetic powder in the planar coil element shown in FIG. 1.

Hereinbelow, the state of the first metal magnetic powder 30 and the second metal magnetic powder 32 contained in the metal magnetic powder-containing resin 20 will be described with reference to FIG. 7.

The major axes of many of particles of the first metal magnetic powder 30 contained in the metal magnetic powder-containing resin 20 located on the upper and lower sides of the coil unit 19 are oriented in the planar direction (direction in the X-Y plane) of the substrate 16. This is because the metal magnetic powder-containing resin 20 located in such positions flows in the planar direction during the above-described screen printing, and therefore the major axes of particles of the first metal magnetic powder 30 are oriented in a direction in which the metal magnetic powder-containing resin 20 flows.

Further, many of particles of the first metal magnetic powder 30 contained in the metal magnetic powder-containing resin 20 located in the magnetic core 21 of the coil unit 19 are inclined particles whose major axes are inclined with respect to the thickness direction (Z direction) and the planar direction (direction in the X-Y plane) of the substrate 16. This is because when the metal magnetic powder-containing resin 20 enters the magnetic core 21 of the coil unit 19 during the above-described screen printing, a direction in which the metal magnetic powder-containing resin 20 enters the magnetic core 21 is not completely parallel with the thickness direction so that the major axes of particles of the first metal magnetic powder 30 contained in the metal magnetic powder-containing resin 20 located in such a position are inclined toward a print direction (i.e., toward a direction in which the squeegee 28 is moved) and are therefore oriented in an obliquely downward direction (in FIG. 7, in a lower right direction).

Figure 8B:
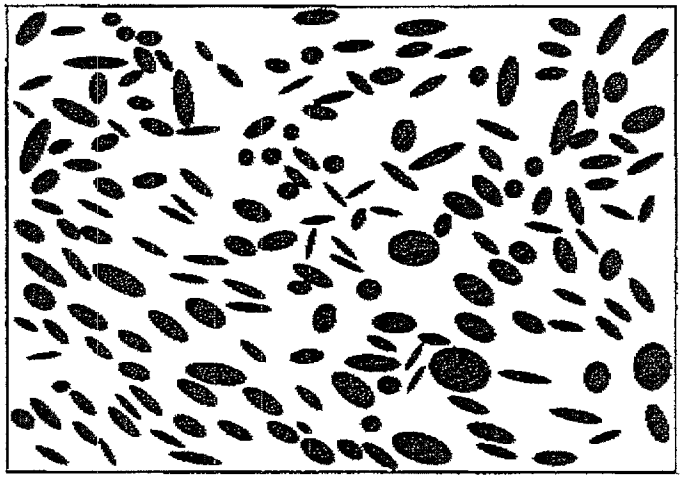
FIG. 8A is a schematic diagram illustrating a state in which particles of a first metal magnetic powder are oriented in a metal magnetic powder-containing resin located on the upper and lower sides of a coil unit and FIG. 8B is a schematic diagram illustrating a state in which particles of the first metal magnetic powder are oriented in the metal magnetic powder-containing resin located in a magnetic core of the coil unit.
Figure 8A:
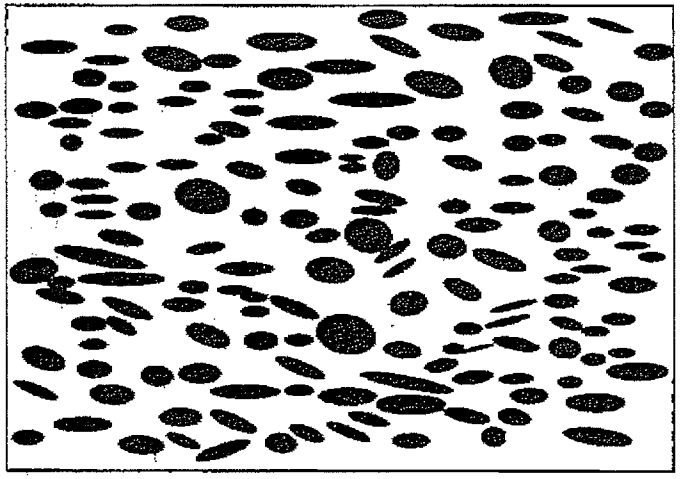

It is to be noted that the state in which the first metal magnetic powder is oriented in the metal magnetic powder-containing resin 20 located on the upper and lower sides of the coil unit 19 may include a state in which, as shown in a schematic diagram of FIG. 8A, not all the particles of the first metal magnetic powder are oriented in the planar direction of the substrate 16 and some of them are inclined with respect to the thickness direction and the planar direction of the substrate 16. Further, the state in which the first metal magnetic powder is oriented in the metal magnetic powder-containing resin 20 located in the magnetic core 21 of the coil unit 19 may include a state in which, as shown in a schematic diagram of FIG. 8B, not all the particles of the first metal magnetic powder are inclined with respect to the thickness direction and the planar direction of the substrate 16 and some of them are oriented in the thickness direction or the planar direction of the substrate 16. However, in the planar coil element 10, the quantitative ratio of inclined particles, which are inclined with respect to the thickness direction and the planar direction of the substrate 16, to total particles of the first metal magnetic powder contained in the metal magnetic powder-containing resin 20 located in the magnetic core 21 of the coil unit 19 needs to be higher than the quantitative ratio of inclined particles, which are inclined with respect to the thickness direction and the planar direction of the substrate 16, to total particles of the first metal magnetic powder contained in the metal magnetic powder-containing resin 20 located on the upper and lower sides of the coil unit 19.

The second metal magnetic powder 32 is uniformly dispersed in the metal magnetic powder-containing resin 20. As described above, since the average particle size of the second metal magnetic powder 32 is much smaller than that of the first metal magnetic powder 30 (average particle size ratio=1/32), particles of the second metal magnetic powder 32 can easily enter the gaps between large particles of the first metal magnetic powder 30.

In this way, the filling factor of metal magnetic powder in the metal magnetic powder-containing resin 20 can be increased by using the first metal magnetic powder 30 and the second metal magnetic powder 32 different in average particle size, which makes it possible to achieve high magnetic permeability. Further, the use of a metal magnetic material makes it possible to obtain a planar coil element superior in direct-current superimposing characteristics as compared to when, for example, ferrite is used.

In the above-described planar coil element 10 and method for producing the planar coil element 10, the metal magnetic powder-containing resin 20 containing the oblate or needle-like first metal magnetic powder 30 contains the second metal magnetic powder 32 having an average particle size (1 μm) smaller than that (32 μm) of the first metal magnetic powder 30, which significantly reduces the viscosity of the metal magnetic powder-containing resin 20. Therefore, the metal magnetic powder-containing resin 20 is easy to handle when applied to enclose the coil unit 19, which makes it easy to produce the planar coil element 10.

(Average Aspect Ratio) FIGS. 9 and 10A to 10C shows the results of an experiment performed by the present inventors to determine the tendency of viscosity to vary with a change in the average aspect ratio of the second metal magnetic powder 30. In this experiment, Samples 1 to 6 were prepared by adding each of three kinds of first metal magnetic powders (permalloy) different in average particle size and a second metal magnetic powder (carbonyl iron) having a low average aspect ratio (1.2) or a high average aspect ratio (2.8), and the viscosity of each of the samples was measured at four different rotation speeds (1, 2.5, 5, and 10).

The six kinds of samples were as follows: Sample 1 containing a combination of a first metal magnetic powder having an average particle size of 32 μm and an average aspect ratio of 2.8 and a second metal magnetic powder having an average particle size of 1 μm and an average aspect ratio of 1.2; Sample 2 containing a combination of a first metal magnetic powder having an average particle size of 21 μm and an average aspect ratio of 2.8 and a second metal magnetic powder having an average particle size of 1 μm and an average aspect ratio of 1.2; Sample 3 containing a combination of a first metal magnetic powder having an average particle size of 40 μm and an average aspect ratio of 2.8 and a second metal magnetic powder having an average particle size of 1 μm and an average aspect ratio of 1.2; Sample 4 containing a combination of a first metal magnetic powder having an average particle size of 32 μm and an average aspect ratio of 2.8 and a second metal magnetic powder having an average particle size of 1 μm and an average aspect ratio of 2.8; Sample 5 containing a combination of a first metal magnetic powder having an average particle size of 21 μm and an average aspect ratio of 2.8 and a second metal magnetic powder having an average particle size of 1 μm and an average aspect ratio of 2.8; and Sample 6 containing a combination of a first metal magnetic powder having an average particle size of 40 μm and an average aspect ratio of 2.8 and a second metal magnetic powder having an average particle size of 1 μm and an average aspect ratio of 2.8. It is to be noted that in the cases of all the samples, the amount of metal magnetic powder contained in the metal magnetic powder-containing resin was set to 97 wt % and the mixing ratio by weight between the first metal magnetic powder and the second metal magnetic powder was set to 75/25.

Figure 10A:
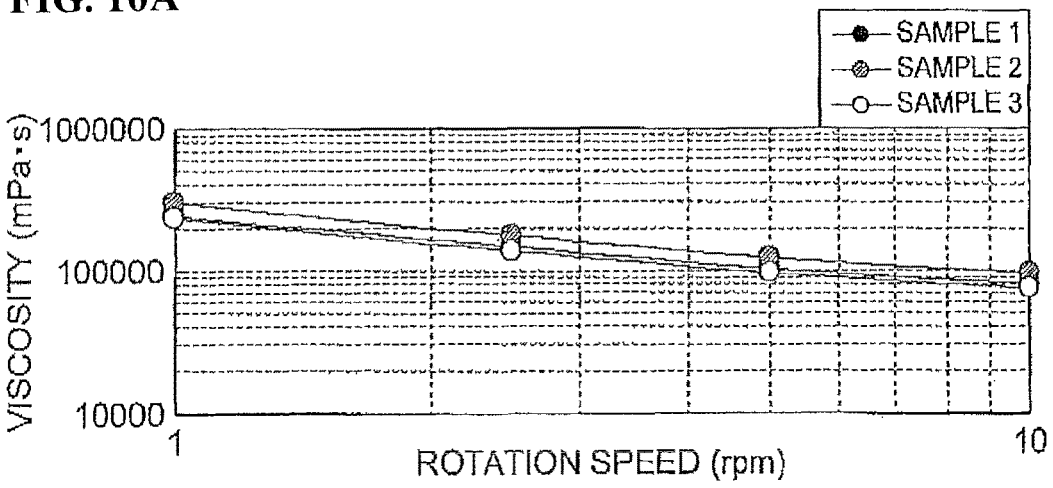
FIGS. 10A and 10B are a graph of Samples 1 to 3, and a graph of Samples 4 to 6 showing the results of an experiment on average aspect ratio, respectively.
Figure 10B:
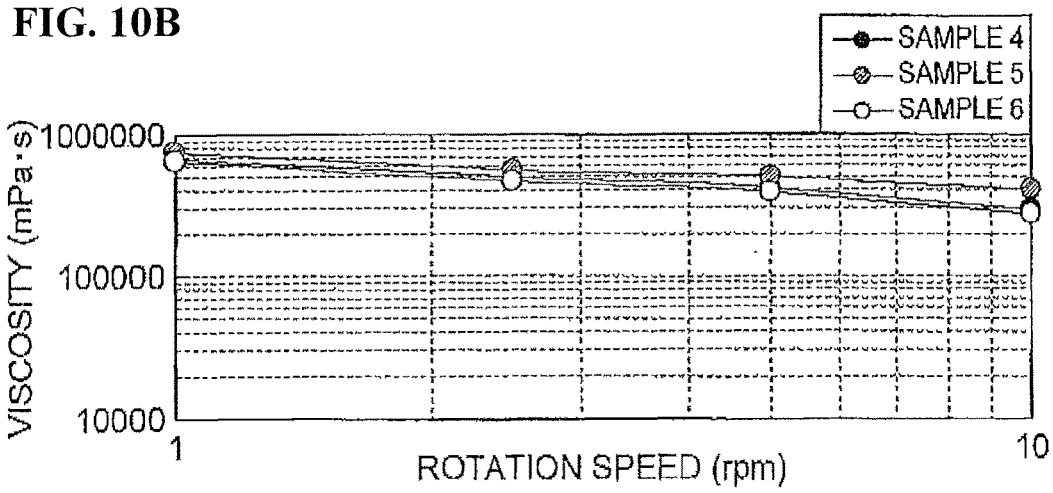

FIG. 9 is a table showing the measurement results. FIGS. 10A and 10B are a rotation speed-viscosity graph of Samples 1 to 3 and a rotation speed-viscosity graph of Samples 4 to 6, respectively.

As is clear from the graphs shown in FIGS. 10A and 10B, the viscosities of Samples 1 to 3 containing the second metal magnetic powder having an aspect ratio of 1.2 tend to be lower than those of Samples 4 to 6 containing the second metal magnetic powder having an aspect ratio of 2.8. This tendency is observed whether the average particle size of the first metal magnetic powder is large or small.

From the results, it can be said that the effect of reducing viscosity is higher when the average aspect ratio of the second metal magnetic powder is smaller (i.e., closer to 1). Therefore, from the viewpoint of viscosity reduction, the second metal magnetic powder 32 preferably has a shape close to a sphere, and for example, the average aspect ratio of the second metal magnetic powder 32 is preferably 1.0 to 1.5.

(Average Particle Size of Second Metal Magnetic Powder) FIG. 11 shows the results of an experiment performed by the present inventors to determine an appropriate range of average particle size of the second metal magnetic powder. In this experiment, the viscosities of three kinds of samples (Sample A, Sample B, and Sample C) different in the average particles size of the second metal magnetic powder were measured at four different rotation speeds (1, 2.5, 5, and 10).

The three kinds of samples were as follows: Sample A containing a combination of a first metal magnetic powder (permalloy) having an average particle size of 32 μm and an average aspect ratio of 2.8 and a second metal magnetic powder (carbonyl iron) having an average particle size of 1 μm; Sample B containing a combination of a first metal magnetic powder having an average particle size of 32 μm and an average aspect ratio of 2.8 and a second metal magnetic powder having an average particle size of 4 μm; and Sample C containing a combination of a first metal magnetic powder having an average particle size of 32 μm and an average aspect ratio of 2.8 and a second metal magnetic powder having an average particle size of 7 μm. It is to be noted that in the cases of all the samples, the amount of metal magnetic powder contained in the metal magnetic powder-containing resin was set to 97 wt % and the mixing ratio by weight between the first metal magnetic powder and the second metal magnetic powder was set to 75/25.

Figures 11A, 11B:
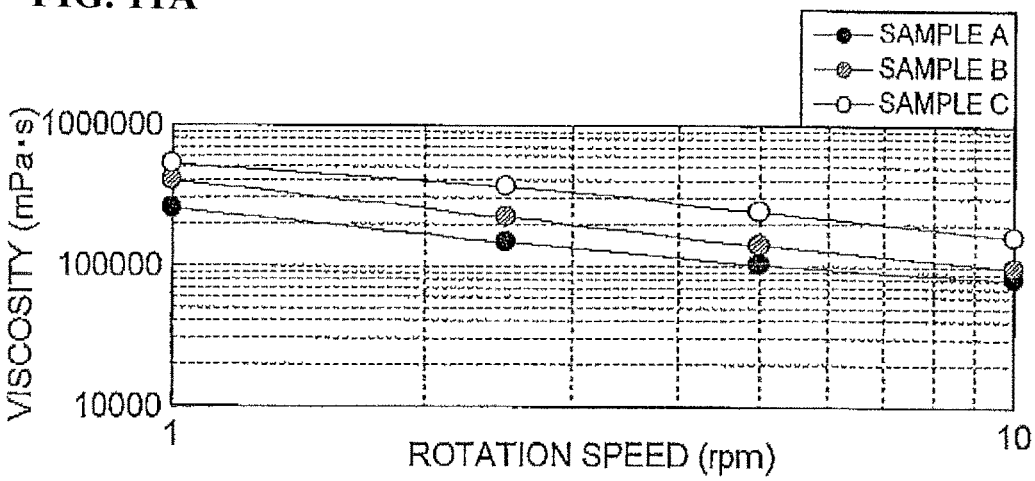
FIGS. 11A and 11B are a graph and a table showing the results of an experiment on the average particle size of a second metal magnetic powder, respectively.

FIGS. 11A and 11B are a graph and a table showing the measurement results, respectively. As is clear from the measurement results shown in FIGS. 11A and 11B, the viscosities of the Sample A containing the second metal magnetic powder having an average particle size of 1 μm and Sample B containing the second metal magnetic powder having an average particle size of 4 μm are sufficiently low from a practical standpoint, from which it is found that the viscosity is significantly reduced when the average particle size of the second metal magnetic powder is in the range of 1 to 4 μm.

FIG. 12 shows the results of an experiment performed in the same manner as described above except that the average particle size of the first metal magnetic powder 30 was changed to 21 μm. Also in this experiment, the viscosities of three samples were measured at the same rotation speeds as above (1, 2.5, 5, and 10).

The three samples were as follows: Sample D containing a combination of a first metal magnetic powder (permalloy) having an average particle size of 21 μm and an average aspect ratio of 2.8 and a second metal magnetic powder (carbonyl iron) having an average particle size of 1 μm; Sample E containing a combination of a first metal magnetic powder having an average particle size of 21 μm and an average aspect ratio of 2.8 and a second metal magnetic powder having an average particle size of 4 μm; and Sample F containing a combination of a first metal magnetic powder having an average particle size of 21 μm and an average aspect ratio of 2.8 and a second metal magnetic powder having an average particle size of 7 μm. It is to be noted that in the cases of all the samples, the amount of metal magnetic powder contained in a metal magnetic powder-containing resin was set to 97 wt % and the mixing ratio by weight between the first metal magnetic powder and the second metal magnetic powder was set to 75/25.

Figures 12A, 12B:
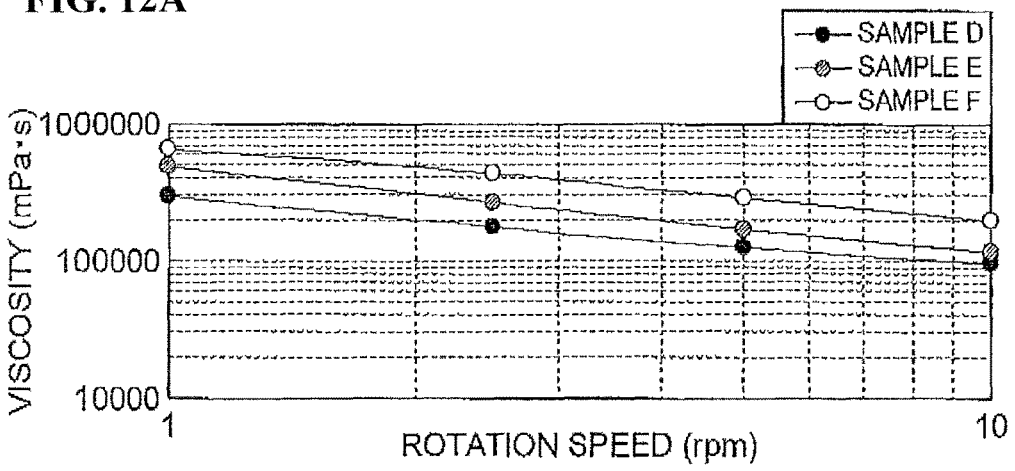
FIGS. 12A and 12B are a graph and a table showing the results of an experiment on the average particle size of a second metal magnetic powder, respectively.

FIGS. 12A and 12B are a graph and a table showing the measurement results, respectively. As is clear from the measurement results shown in FIGS. 12A and 12B, the viscosities of the Sample D containing the second metal magnetic powder having an average particle size of 1 μm and Sample E containing the second metal magnetic powder having an average particle size of 4 μm are sufficiently low from a practical standpoint, from which it is found that the viscosity is significantly reduced when the average particle size of the second metal magnetic powder is in the range of 1 to 4 μm.

FIG. 13 shows the results of an experiment performed in the same manner as described above except that the average particle size of the first metal magnetic powder 30 was changed to 40 μm. Also in this experiment, the viscosities of three samples were measured at the same rotation speeds as above (1, 2.5, 5, and 10).

The three samples were as follows: Sample G containing a combination of a first metal magnetic powder (permalloy) having an average particle size of 40 μm and an average aspect ratio of 2.8 and a second metal magnetic powder (carbonyl iron) having an average particle size of 1 μm; Sample H containing a combination of a first metal magnetic powder having an average particle size of 40 μm and an average aspect ratio of 2.8 and a second metal magnetic powder having an average particle size of 4 μm; and Sample I containing a combination of a first metal magnetic powder having an average particle size of 40 μm and an average aspect ratio of 2.8 and a second metal magnetic powder having an average particle size of 7 μm. It is to be noted that in the cases of all the samples, the mixing ratio by weight between the first metal magnetic powder and the second metal magnetic powder was set to 75/25.

Figures 13A, 13B:
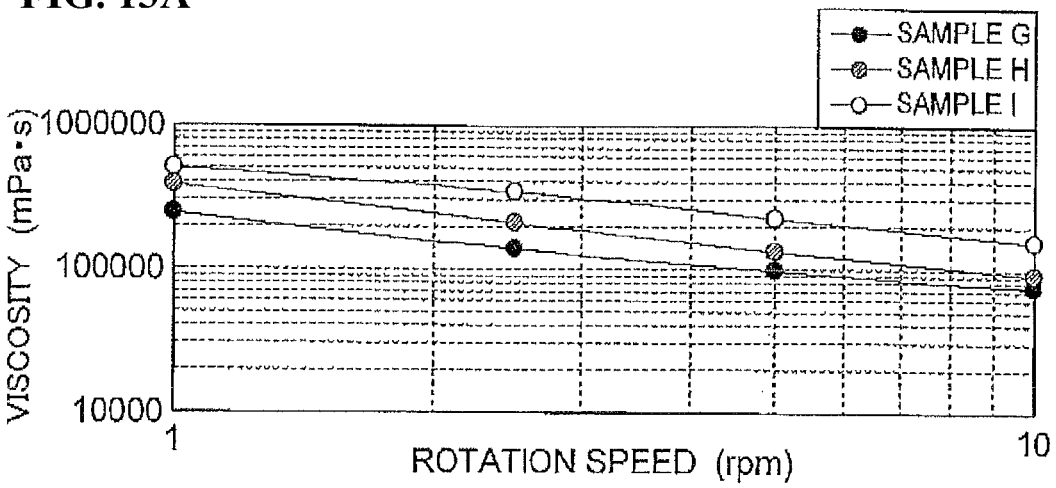
FIGS. 13A and 13B are a graph and a table showing the results of an experiment on the average particle size of a second metal magnetic powder, respectively.

FIGS. 13A and 13B are a graph and a table showing the measurement results, respectively. As is clear from the measurement results shown in FIGS. 13A and 13B, the viscosities of the Sample G containing the second metal magnetic powder having an average particle size of 1 μm and Sample H containing the second metal magnetic powder having an average particle size of 4 μm are sufficiently low from a practical standpoint, from which it is found that the viscosity is significantly reduced when the average particle size of the second metal magnetic powder is in the range of 1 to 4 μm.

From the above experimental results, it has been found that the viscosity is significantly reduced when the average particle size of the second metal magnetic powder is in the range of 1 to 4 μm whether the average particle size of the first metal magnetic powder 30 is large or small. Therefore, from the viewpoint of viscosity reduction, the average particle size of the second metal magnetic powder 32 used in the planar coil element 10 is set to a value in the range of 1 to 4.

It is to be noted that the present invention is not limited to the above-described embodiment, and various changes may be made.

For example, a constituent material of the first metal magnetic powder may be an amorphous alloy, an FeSiCr-based alloy, Sendust, or the like instead of an iron-nickel alloy (permalloy). Further, unlike the above embodiment in which the conductor patterns for planar coil are provided on both upper and lower sides of the substrate, the conductor pattern for planar coil may be provided on only one of the upper and lower sides of the substrate.

What is claimed is:

1. A planar coil element comprising:

a coil unit including a substrate and a conductor pattern for planar coil provided on the substrate;

a metal magnetic powder-containing resin applied to enclose the conductor pattern of the coil unit;

an oblate or needle-like first metal magnetic powder contained in the metal magnetic powder-containing resin; and a spherical second metal magnetic powder contained in the metal magnetic powder-containing resin and having an average particle size smaller than an average particle size of the first metal magnetic powder, wherein both the first metal magnetic powder and the second metal magnetic powder are uniformly dispersed in the metal magnetic powder-containing resin, and at least a portion of the first metal magnetic powder contained in the metal magnetic powder-containing resin is inclined with respect to a thickness direction and a planar direction of the substrate.

2. The planar coil element according to claim 1, wherein the second metal magnetic powder has an average aspect ratio of 1.0 to 1.5.

3. The planar coil element according to claim 1, wherein the second metal magnetic powder has an average particle size of 1 to 4 μm.

4. The planar coil element according to claim 1, wherein the conductor pattern is a planar spiral pattern.

5. The planar coil element according to claim 1, wherein the substrate is made of resin.

6. The planar coil element according to claim 1, wherein the conductor pattern is formed on the substrate by plating.

7. The planar coil element according to claim 1, wherein the metal magnetic powder-containing resin consists of a single type of resin material.

8. A method for producing a planar coil element comprising the steps of:

preparing a coil unit including a substrate and a conductor pattern for planar coil provided on the substrate;

preparing a metal magnetic powder-containing resin paste containing an oblate or needle-like first metal magnetic powder and a spherical second metal magnetic powder having an average particle size smaller than an average particle size of the first metal magnetic powder; and applying the metal magnetic powder-containing resin paste to enclose the conductor pattern of the coil unit, inclining at least a portion of the first metal magnetic powder with respect to a thickness direction and a planar direction of the substrate, and curing the metal magnetic powder-containing resin paste, wherein both the first metal magnetic powder and the second metal magnetic powder are uniformly dispersed in the metal magnetic powder-containing resin.

9. The method for producing a planar coil element according to claim 8, wherein the second metal magnetic powder has an average aspect ratio of 1.0 to 1.5.

10. The method for producing a planar coil element according to claim 8, wherein the second metal magnetic powder has an average particle size of 1 to 4 μm.

* * * * *